United States Patent [19]

Shepard

[11] Patent Number: 4,795,095

[45] Date of Patent: Jan. 3, 1989

[54] ROTARY ATOMIZER

[75] Inventor: Ray M. Shepard, Monticello, Ind.

[73] Assignee: Shepard Industries, Inc., Monticello, Ind.

[21] Appl. No.: 904,930

[22] Filed: Sep. 8, 1986

[51] Int. Cl.[4] ..... B05B 3/02; B05B 3/10; B05B 1/28

[52] U.S. Cl. ..... 239/214.17; 239/224; 239/290

[58] Field of Search ..... 239/104, 214.11, 214.17, 239/214.19, 223, 224, 290, 703, 214.25

[56] References Cited

U.S. PATENT DOCUMENTS

| | | | |
|---|---|---|---|
| 1,158,058 | 10/1915 | King | 239/214.19 |
| 1,162,120 | 11/1915 | Witt | 239/214.17 |
| 2,711,926 | 6/1955 | Allander . | |
| 2,784,351 | 3/1957 | Renner | 239/703 X |
| 3,082,956 | 3/1963 | Point | 239/703 |
| 3,199,786 | 8/1965 | Waldrum . | |
| 3,224,680 | 12/1965 | Burnside et al. . | |
| 3,281,076 | 10/1966 | Burnside et al. . | |
| 3,552,650 | 1/1971 | Patrick . | |
| 4,222,523 | 9/1980 | Bals . | |
| 4,225,084 | 9/1980 | Bals . | |
| 4,275,838 | 6/1981 | Fangmeyer . | |
| 4,398,672 | 8/1983 | Arnold et al. | 239/703 X |
| 4,458,844 | 7/1984 | Mitsui | 239/703 |
| 4,519,549 | 5/1985 | Yokoe et al. | 239/703 |
| 4,609,145 | 9/1986 | Miller | 239/223 X |

OTHER PUBLICATIONS

Article from Progressive Farmer Magazine, 1982, p. 1 Entitled "Precision Spraying: A New System That Can Slash Your Costs," by Ken Bretches.

Brochure Entitled "Specifications/Facts—Rota--Mizer," Published by Farm Fans, Inc., Indianapolis, In.

Brochure Entitled "Rota-Mizer Spray Ram Operator's Manual," Published by Farm Fans, Inc., Indianapolis, In.

Brochure Entitled "Spray-Ram", Published by Spray-rite Mfg. Co., West Helena, Ar.

*Primary Examiner*—Douglas C. Butler
*Assistant Examiner*—Patrick N. Burkhart
*Attorney, Agent, or Firm*—Emrich & Dithmar

[57] ABSTRACT

A rotary atomizer includes a generally circular integrated fan/cone assembly coupled to an hydraulic motor to effect the rotation thereof. The hydraulic motor is positioned upon and extends through a generally circular fixed shroud which is downwardly divergent and includes a center hub with air intake apertures. The integrated fan/cone assembly is positioned immediately below and within the shroud and further includes a disc-shaped base on the upper surface of which are disposed a plurality of spaced curvilinear blades and within the center portion thereof is located a truncated cone having an upper center hub and a plurality of spaced radial grooves around the lower inner surface thereof. Each of the grooves is defined by a pair of spaced, tapered ribs each of which, in turn, terminates in a respective generally rectangular tooth which extends downward from and beyond the lower lip of the cone. Fluid is introduced onto the upper center hub of the cone and flows downward through apertures therein onto an upper, inner smooth portion of the cone and then into the spaced radial grooves therein to exit the cone via the teeth on the lower peripheral edge thereof. The fluid is thus formed into small uniform droplets in a relatively turbulence-free zone with the thus formed droplets then directed outwardly into the radial airflow generated above the cone by the curvilinear fan blades for dispersal of the droplets in a generally circular pattern.

18 Claims, 3 Drawing Sheets

ROTARY ATOMIZER

BACKGROUND OF THE INVENTION

This invention relates generally to fluid atomizers and is particularly directed to a rotary atomizer which provides a high degree of control over droplet size and spray pattern.

Crop spraying is a widespread method for protecting crops from pests as well as for restricting the growth of other, competing forms of plants. Early approaches to crop spraying involved the mixing of a pesticide with water and discharging the mixture under pressure through a hydraulic nozzle. Upon discharge, the motion of the mixture droplets is affected by wind velocity prior to deposit upon the soil and/or crops. So long as the drift is uniform, i.e., the same for all droplets, the location of incidence of the mixture droplets can be fairly accurately controlled. However, where the droplets differ substantially in size, the smaller droplets will be influenced by the surrounding air currents in a manner different from that of the larger droplets and will thus be deposited in locations different from those upon which the larger drops are incident. Irregularities in the spraying pattern will cause overspraying in some areas and inadequate spraying as well as failure to deposit the fluid mixture on other areas. The early use of water as a medium for transport of the pesticide gave way to the use of various oils such as vegetable oils which tend to provide more uniform droplet size. However, hydraulic nozzles still suffer from the inability to control droplet size and to accurately spray the pesticide mixture over the intended area.

The hydraulic nozzle approach is increasingly being replaced by Controlled Droplet Applicators (CDA) which offer the advantage of droplet size control and thus increase the effectiveness of pesticide application. CDA's generally include an electrically or hydraulically actuated motor for rotating a generally circular element upon and over which the mixture to be sprayed is caused to flow. The rotating element, which is frequently in the form of a cup, discharges the mixture in a radial direction at high speed after breaking it up into small droplets. Generally, a high speed air flow is directed across the edge of the rotating discharge device to facilitate removal of the mixture from the rotating atomizer and to displace it radially with respect thereto. A generally circular spray pattern is thus produced, with a plurality of such CDA's providing continuous coverage over the length of a spray boom to which the CDA's are mounted by positioning the various spray patterns in an overlapping manner.

While CDA's have generally improved the atomization of the sprayed chemical, increasing its deposit on larger intended areas and thus reducing the amount of chemical required, even this approach suffers from performance limitations. For example, prior art CDA's do not provide uniform spray distribution because of fluid flow characteristics on and about its rotary atomizer. This undesirable nonuniform spray distribution, or streaking, may be caused by the interaction of the air flow with the formed droplets, the manner in which the droplets separate from the rotary atomizer, an irregular and nonuniform fluid flow within the rotating atomizer, or any number of other fluid flow factors or air flow characteristics of the CDA. For example, it is not enough to break the spray chemical into the smallest possible droplets in order to maximize the area of coverage. If all of the minute droplets are not of the same general size, their distribution within the spray will also be nonuniform and the sprayed area will be covered in an irregular manner by the deposited mixture.

The present invention is intended to overcome the aforementioned limitations of the prior art by providing a rotary atomizer for forming droplets of uniform size which, in turn, are distributed uniformly throughout the entire spray pattern for more even distribution of the sprayed mixture. The rotary atomizer of the present invention uses a single rotating element to form droplets of essentially the same size in a circular pattern and then directs a high velocity air flow over the thus formed droplets which are then widely dispersed in a uniform manner.

OBJECTS AND SUMMARY OF THE INVENTION

Accordingly, it is an object of the present invention to provide an improved fluid atomizer and sprayer.

It is another object of the present invention to provide a controllable and more uniform droplet size in an atomized fluid.

Yet another object of the present invention is to provide an improved controlled droplet applicator which permits continuous and precisely controlled variation of droplet size and application rate over a wide range of values.

Still another object of the present invention is to provide an improved controlled droplet applicator arrangement particularly adapted for agricultural use which provides improved crop penetration and more consistent, reliable, and uniform crop coverage.

A further object of the present invention is to provide a more reliable fluid atomizer/sprayer arrangement which is particularly adapted for controlled droplet applications to crops.

It is a still further object of the present invention to provide an even distribution of droplets in a cone-shaped pattern using a single rotating element in a fluid atomizer/sprayer.

This invention contemplates a rotary atomizer driven by a hydraulic motor which includes, a generally circular, dish-like shroud which is downwardly divergent and has a center hub with a plurality of air intakes. The hydraulic motor is mounted to and extends through the shroud's hub and is coupled to an integrated fan/con assembly. The integrated assembly includes a disc-shaped base, on the upper surface of which are positioned a plurality of spaced, curvilinear blades forming a fan for directing air radially outward against the inner surface of the shroud. In the center of the circular base and extending below the plane thereof is a truncated, conical cup which also has an upper center hub with a plurality of apertures therein. The inner surface of the conical cup includes an upper smooth portion which is continuous with the periphery of its hub and allows for the downward flow of the fluid to be vaporized via the hub apertures. The lower inner surface of the conical cup includes a plurality of spaced, tapered, radial ribs defining parallel grooves in he cup, which grooves carry the downward flowing fluid to the lower, peripheral edge of the cup on which are disposed a plurality of spaced teeth, each continuous with a respective rib on the inner surface of the cup. High sped rotation of the cup causes the fluid to be discharged in a radial outward direction and to form into a radially expanding distribution of droplets which are then directed into the high velocity air stream generated by the fan blades and are further directed downwardly and radially outward by the shroud.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
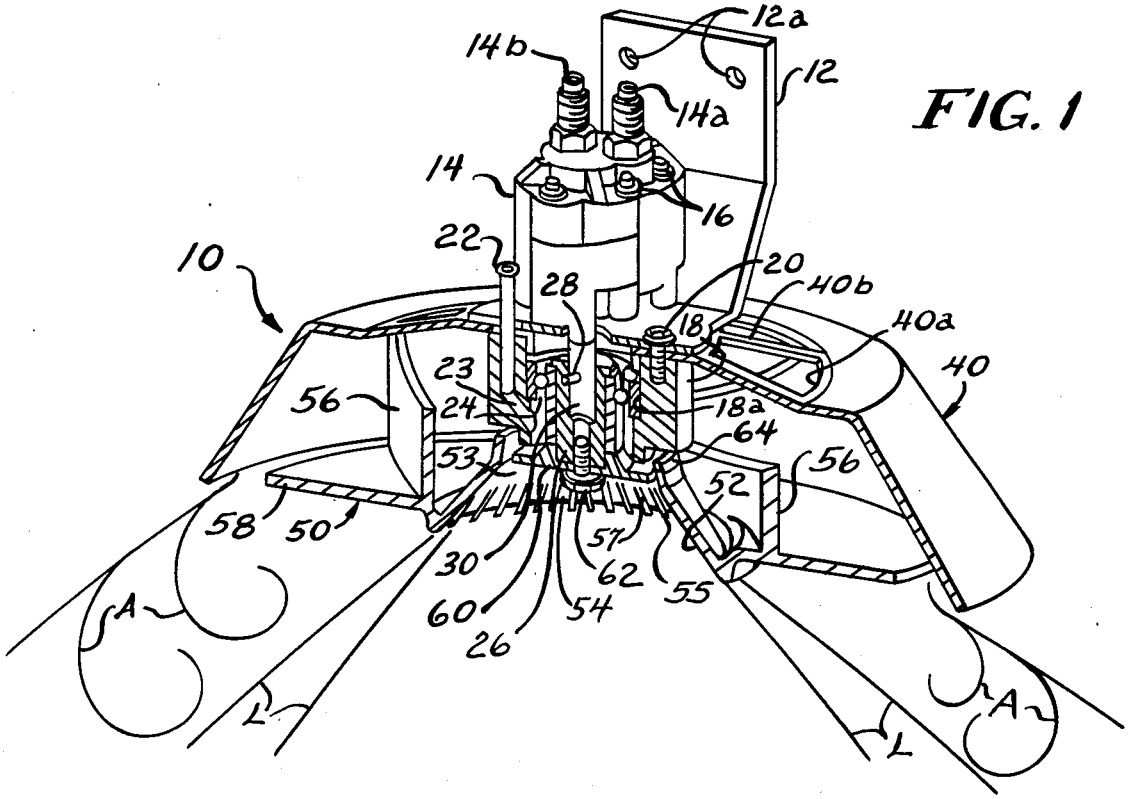
FIG. 1 is a partially cutaway perspective view of a rotary atomizer in accordance with the principles of the present invention.

Referring to FIGS. 1 and 4 through 6, there are shown various views of an improved rotary atomizer 10 in accordance with the present invention.

The rotary atomizer 10 is coupled to and rotationally displaced by means of an hydraulic motor 14. The hydraulic motor 14 may be conventional in design and operation and includes an inlet fitting or adapter 14*a* and an outlet fitting or adapter 14*b*. The inlet and outlet fittings 14*a*, 14*b* may be coupled to a hydraulic reservoir and source of hydraulic pressure for rotationally displacing a hydraulic motor shaft 30 which extends downward from the hydraulic motor 14. The hydraulic reservoir/pressure source is not shown in the various figures for simplicity as it does not form a part of the present invention and may be conventional in design and operation. The rotary atomizer 10 of the present invention may also be coupled to and driven by an electric motor, although for the high rotational speeds required for proper dispersion of the atomized droplets in most applications, an hydraulic motor as shown in the figures is preferred. The hydraulic motor 14 includes a plurality of mounting bolts 16 for securely attaching the hydraulic motor to a mounting bracket 12. The mounting bracket 12, in turn, includes a plurality of apertures 12*a* therein for mounting the rotary atomizer of the present invention to a spray boom 44 as shown for the case of a plurality of rotary atomizers 10 in FIG. 2.

The mounting bracket 12 further includes a center aperture through which the hydraulic motor shaft 30 extends as well as a pair of peripheral apertures through which a respective feeder tube 22 extends. Only one feeder tube 22 is shown in the various figures for simplicity, although the present invention contemplates a pair of such feeder tubes positioned within and extending through a lower portion of the mounting bracket 12 adjacent to respective opposed, lateral portions of the hydraulic motor 14. Also positioned within a lower portion of the mounting bracket 12 are a plurality of apertures concentrically positioned about the hydraulic motor 14 through which a respective mounting bolt 20 extends for engaging a bearing retainer assembly 18. The bearing retainer assembly 18 is thus positioned beneath a lower portion of the mounting bracket 12 and is securely coupled thereto by means of the plurality of mounting bolts 20.

Disposed between a lower portion of the mounting bracket 12 and the bearing retainer assembly 18 is the center hub portion of a generally circular, downwardly divergent shroud 40. The hub portion of the shroud 40 includes a center aperture through which the hydraulic motor shaft 30 extends and further includes a plurality of air inlets 40*a* positioned about the shroud's center aperture. The air inlets 40*a* of the shroud 40 are defined by the outer periphery of the shroud's center hub, an outer, peripheral portion of the shroud, and a plurality of spoked ribs 40*b* which couple the shroud's hub to its outer, peripheral portion. As shown in the various figures, the shroud 40 is securely coupled to the mounting bracket 12 by means of the mounting bolts 20 inserted in the bearing retainer 18 and is thereby maintained in a downwardly divergent orientation.

The bearing retainer 18 includes a center aperture within which a bearing assembly 24 is positioned. The center aperture of the bearing retainer 18 includes a notched portion 18*a* which is adapted to receive and engage the outer periphery of the bearing assembly 24 and to maintain the bearing assembly securely within the bearing retainer. With the bearing assembly 24 thus supported by and maintained in position within the bearing retainer 18, an annular chamber 32 is defined between the bearing retainer and the bearing assembly. The bearing assembly 24 also includes a center aperture within which a generally cylindrical coupler 26 is positioned. An upper, outer lip 26*a* of the coupler 26 is adapted to engage the upper surface of the bearing assembly 24 for maintaining the coupler securely in position within the bearing assembly. The coupler 26 also includes a center, longitudinal aperture therein which is adapted to receive the hydraulic motor shaft 30. Coupling between the hydraulic motor shaft 30 and the coupler 26 is provided by means of a roll pin 28 inserted within respective, aligned apertures in the coupler and the hydraulic motor shaft. With the coupler 26 thus securely connected to the hydraulic motor shaft 30, operation of the hydraulic motor 14 causes the coupler 26 and the inner portion of the bearing assembly 24 to rotate while the outer portion of the bearing assembly, the bearing retainer 18 and the shroud 40 are maintained fixed.

Securely coupled to the lower end portion of the rotatable coupler 26 by means of a mounting bolt 62 is an integral fan/cone 50. The integral fan/cone 50 includes a center hub portion 60 having an aperture therein through which the mounting bolt 62 is inserted for threadably engaging the lower end portion of the coupler 26. An upper surface of the integral fan/cone's hub 60 is recessed so as to receive the lower end portion of the coupler 26 therein in a tight fitting manner. The center hub 60 further includes a plurality of apertures 60*a* around the periphery thereof which are separated by a plurality of spoked members similar to the hub portion of the shroud 40. These spoked members couple the hub 60 to an upper, inner portion of a cone 52 which is truncated in a preferred embodiment. Positioned on an upper edge of the cone 52 around the periphery thereof is a ring 64. The hub 60 of the integral fan/cone 50 forms an upper end portion of the cone 52. A lower, outer end of the inverted cone 52 is coupled to and integral with a base 58. The base 58 is generally disc-shaped and includes a center aperture therein defined by the cone 52. Positioned on the upper flat surface of the base 58 are a plurality of spaced, curvilinear blades 56. Rotation of the hydraulic motor shaft 30 results in corresponding displacement of the coupler 26 and the integral fan/cone 50 coupled thereto by means of its center hub 60. Thus, the cone 52, the generally flat, disc-like base 58, and the curvilinear blades 56 positioned thereon, all of which comprise the integral fan/-cone 50, are rotationally displaced by the hydraulic motor 14. The curvilinear blades 56 on the upper surface of the integral fan/cone's base 58 are shaped so as to direct air radially outward against the inner surface of the shroud 40 which then deflects the air downward and radially outward from the rotary atomizer 10 as indicated by the flow lines designated with the letter A in FIG. 1. The air inlets **40*a* in the upper portion of the shroud 40 allow a continuous flow of air to be drawn into the rotary atomizer 10 and to be directed radially outward therefrom at high velocity by the rotating integral fan/cone 50**.

The fluid to be atomized is directed into the feed tubes 22 from a reservoir or other means as indicated above. The fluid flows downward within each of the feed tubes 22 which are located in diametrically opposed portions of the bearing retainer 18. Also positioned within respective diametrically opposed portions of the bearing retainer 18 are a pair of ducts 23 which are immediately adjacent to and continuous with lower end portions of a respective feeder tube 22. Fluid deposited in a feeder tube 22 thus flows downward into a respective duct 23 adjacent thereto and continuous therewith and into the annular chamber 32 between the bearing retainer 18 and the coupler 26. From the annular chamber 32, the lower portion of which is defined by the integral fan/cone's hub 60, the fluid continues its downward flow through respective apertures **60*a* within the hub. After flowing through the peripheral apertures in the integral fan/cone's hub 60, the fluid continues its downward flow on the inner surface of the inverted cone 52 as shown by the flow lines illustrated in FIG. 4**.

The inner surface of the cone 52 is defined by an upper smooth portion 53 and a lower portion having a plurality of spaced radial grooves 54 therein. The radial grooves 54 are located immediately beneath the smooth upper portion 53 of the cone, with each groove defined by a pair of spaced tapered ribs 57 positioned on the inner surface of the cone. Each of the ribs 57 includes an upper tapered end and terminates on the lower end thereof in a respective toothed portion 55. The lower edge of the cone 52 is thus provided with a plurality of spaced, generally rectangular teeth 55 disposed around the periphery thereof.

The rotary atomizer 10 of the present invention operates in the following manner to provide uniform droplet size and improved control over the spray pattern. The liquid to be atomized flows from the annular chamber 32 between a lower end portion of the bearing 18 and the upper surface of the hub 60 and through the peripheral apertures **60*a* within the hub. The space between the bearing retainer 18 and the hub 60 serves as a metering gate to provide a smooth, continuous flow of fluid through the peripheral apertures 60*a* within the hub 60. This continuous, even flow of fluid through the hub apertures 60*a* ensures a uniform distribution of fluid on the inner surface of the cone 52** to provide a continuous, uniform spray pattern.

The ring 64 positioned around the upper edge of the cone 52 prevents the centrifugally displaced fluid from flowing upward and over the cone's upper edge. The ring 64 thus directs the centrifugally displaced fluid downward along the innersurface of the cone 52 as shown by the direction of the flow lines in FIG. 4. As the fluid exits the hub apertures **60*a*, it encounters the smooth, upper inner surface 53 of the cone 52 and is distributed in a uniform, sheath-like manner about the inner circumference of the cone. Continued downward flow of the fluid on the inner surface of the cone 52 causes the fluid to encounter the upper tapered ends of the spaced ribs 57. The upper tapered ends of the spaced ribs 57 direct the fluid into the radial grooves 54 defined by the spaced ribs in a continuous flow manner so as to distribute the fluid uniformly, with each groove carrying a continuous stream of fluid towards its lower end. The large apertures 60*a* within the integral fan/cone's hub 60 permit a large volume of fluid to be deposited on the upper, smooth surface 53 of the cone 52 and to be directed into the spaced radial grooves 54 thereon. Continued downward flow of the fluid within the lower radial grooves 54 of the rotating cone 52 causes the fluid to flow into the space between adjacent teeth 55 on the lower edge thereof, whereupon the continuous streams of fluid within the radial grooves are broken up into droplets and are directed radially outward from the integral fan/cone 50. The dispersion pattern of these droplets is generally between the flow lines indicated by the letter L in FIG. 1**.

As the droplets are displaced radially outward from the lower edge portion of the cone 52, the curvilinear blades 56 on the upper portion of the integral fan/cone 50 direct air radially outward from the integral fan/-cone. This air flow is directed against the inner surface of the shroud 40 which, in turn, directs the high velocity air in a continuous, uniform stream in a downward and radially outward direction from the lower edge of the shroud. As shown in FIG. 1, the dispersed atomized droplets are directed into the radially outward air flow and are carried at high speed by the thus directed air. It can be seen that the base 58 isolates the high velocity air flow from the lower edge of the inverted cone 52 and the zone within which the droplets are formed. Therefore, the fluid droplets are formed in a generally turbulence-free zone beneath the zone of high velocity air flow, with the droplets then directed into the air flow following their formation. In this manner, the droplets are dispersed in a uniform manner about the rotary atomizer to provide a more predictable and controllable droplet dispersal pattern. The air flow pattern thus forms a penumbra about the zone within which the droplets are formed and into which the thus formed droplets are directed in a uniform, continuous manner. An extension lip **52*a* about the lower edge of the cone 52** provides separation between the cone's lower edge and the rotating base to isolate the zone within which the droplets are formed from any turbulence of the base itself.

Figure 2:
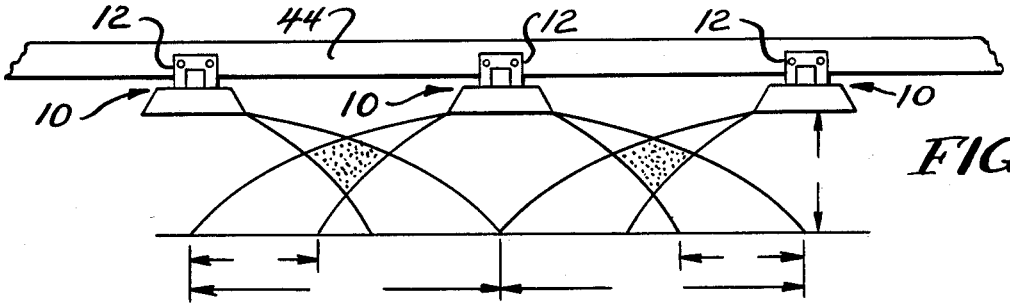
FIGS. 2 and 3 are respectively vertical and horizontal plan views illustrating the overlap of the spray trajectories of a plurality of rotary atomizers positioned along the length of a spray boom in accordance with the present invention.
Figure 3:
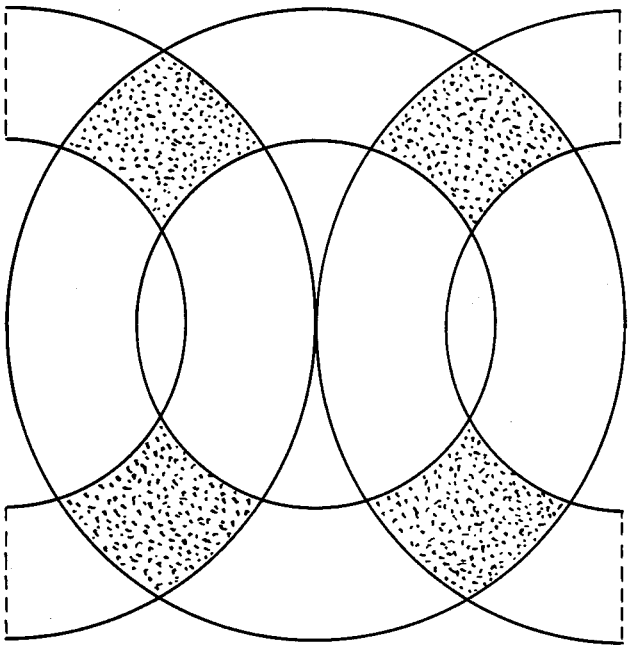
Figure 4:
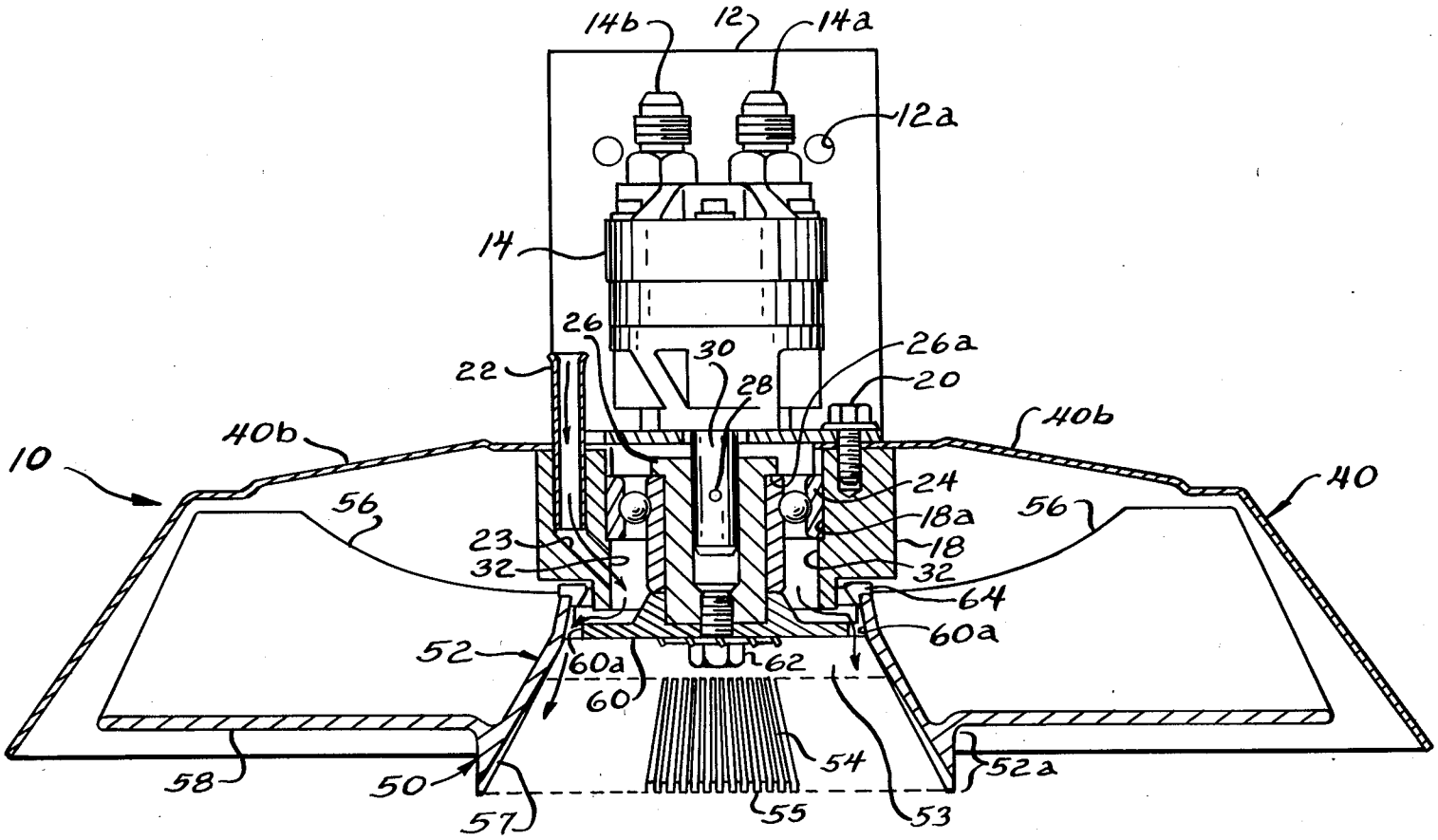
FIG. 4 is a vertical sectional view of the rotary atomizer of the present invention taken along sight line 4—4 in FIG. 6.
Figure 5:
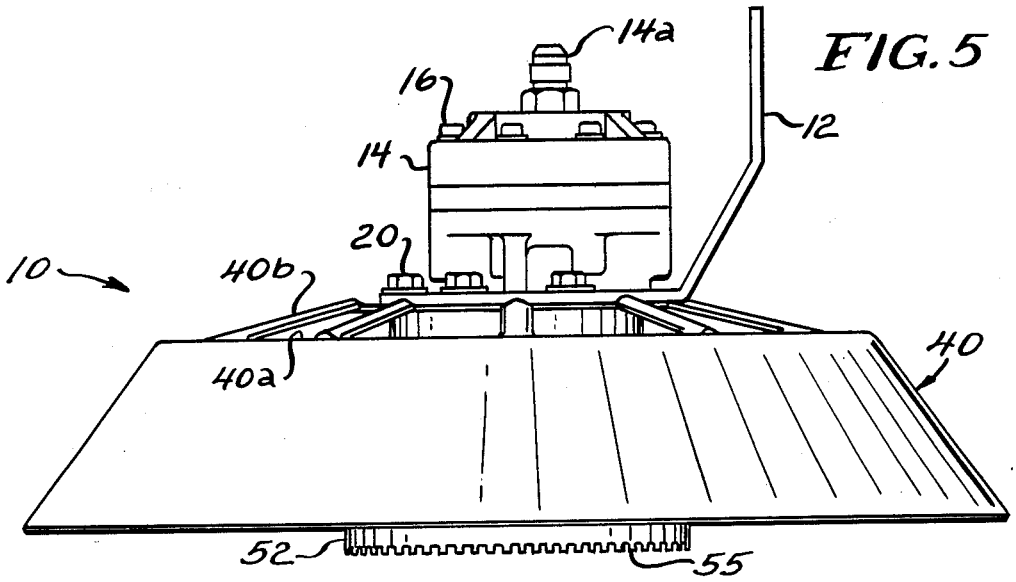
FIG. 5 is a lateral view of the rotary atomizer of FIG. 1.
Figure 6:
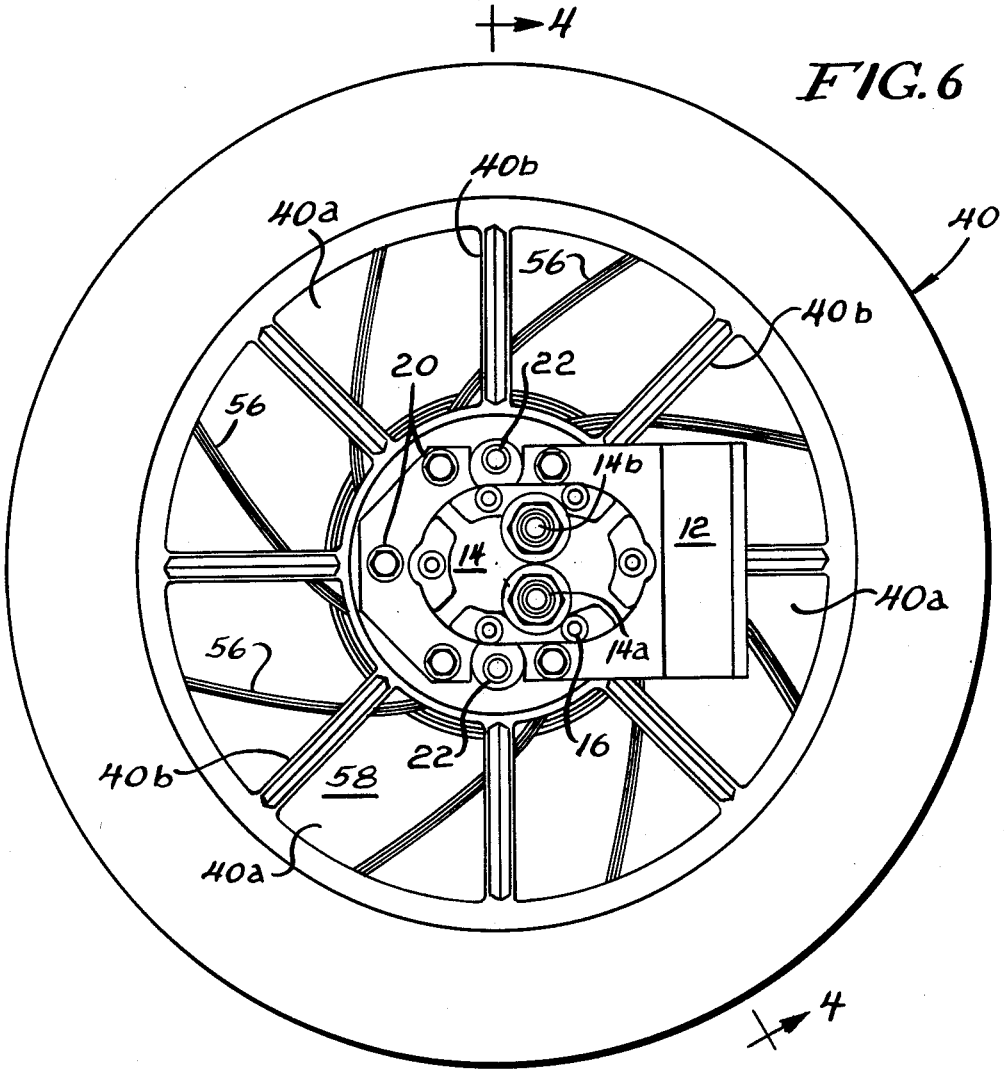
FIG. 6 is a top plan view of the rotary atomizer of FIG. 1.

Referring to FIGS. 2 and 3, there are respectively shown vertical and horizontal plan views of the spray pattern of a plurality of rotary atomizers 10 of the present invention positioned in a spaced manner upon and along the length a spray boom 44. From these figures, it can be seen that the radially outward displaced droplets from adjacent rotary atomizers 10 are distributed in an overlapping manner to provide a continuous, uniform distribution of the droplets over the sprayed area. The droplets from one rotary atomizer thus encounter the air flow from an immediately adjacent atomizer to further agitate the droplets and improve the uniformity of distribution of the droplets.

There has thus been shown an improved rotary atomizer which provides a continuous, uniform fluid flow to the inner surface of a rotating cone which directs the fluid into a plurality of spaced radial grooves therein. The upper inner surface of the cone is smooth, with the tapered upper ends of a plurality of spaced ribs forming radial grooves providing continuous fluid flow within the grooves formed by the ribs. Continued downward, radial flow of the fluid within the grooves results in discharge of the fluid in the form of droplets from the lower edge of the rotating cone which is provided with a plurality of spaced teeth. A fan assembly positioned above and separated from the rotating cone directs a high velocity air flow onto the thus dispersed droplets in a radial direction carrying the droplets outward from the rotary atomizer in a uniform, circular pattern.

While particular embodiments of the present invention have been shown and described, it will be obvious to those skilled in the art that changes and modifications may be made without departing from the invention in its broader aspects. For example, while the fan assembly and inverted cone are shown in a preferred embodiment as formed of a single integrated structure, the present invention is not limited to such a configuration and contemplates an arrangement wherein each component may be comprised of separate elements which may be securely coupled together so as to form an integral structure. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A rotary atomizer comprising:

rotational drive means;

air displacement means coupled to said rotational drive means and rotated about a central axis for directing air radially outward therefrom;

a hollow cone positioned beneath said air displacement means and aligned along said central axis, wherein said cone is coupled to and rotationally displaced by said rotational drive means for forming a fluid provided to an upper, inner portion of said cone into a plurality of uniform sized drip lets and for discharging the thus formed droplets in an outward radial direction from a lower, peripheral edge thereof;

isolation means positioned between said air displacement means and the lower, peripheral edge of said cone for separating the radially directed air from the fluid droplets as they are discharged from said cone, wherein said isolation means includes a generally flat disc having a center aperture defined by said cone and wherein said air displacement means is positioned on an upper surface of said disc;

an extension lip disposed on said cone and positioned between the lower edge of said cone and said isolation means for providing displacement therebetween and reducing any turbulence generated by said isolation means to which the newly formed droplets may be subject; and fixed deflector means for directing the radially outward flowing air onto the radially outward directed fluid droplets in forming a uniform, continuous circular spray pattern.

2. The rotary atomizer of claim 1 wherein said air displacement means is further coupled to said hollow cone and forms an integral structure therewith.

3. The rotary atomizer of claim 2 wherein said air displacement means includes a plurality of curvilinear blades each coupled at a first inner end thereof to an outer portion of said hollow cone and arranged in a spaced manner about the periphery of said cone.

4. The rotary atomizer of claim 1 wherein said isolation means is coupled to and integral with said air displacement means and said hollow cone.

5. The rotary atomizer of claim 1 wherein said deflector means comprises a generally circular shroud positioned above and around the periphery of said air displacement means.

6. The rotary atomizer of claim 5 wherein said deflector means includes an air intake aperture positioned in an upper portion thereof.

7. The rotary atomizer of claim 6 further comprising bearing means for coupling said shroud to said rotational drive means for allowing said shroud to assume a fixed, nonrotating position.

8. The rotary atomizer of claim 7 further comprising mounting means for fixedly securing said rotational drive means and said shroud to a sprayer support member.

9. The rotary atomizer of claim 1 wherein said rotational drive means includes a rotary hydraulic motor.

10. The rotary atomizer of claim 1 wherein said cone includes an upper hub having a plurality of apertures for laterally confining and directing the fluid onto the upper, inner portion of said cone.

11. The rotary atomizer of claim 10 wherein the upper, inner portion of said cone is smooth to form the fluid in a continuous, sheath-like flow pattern thereon.

12. The rotary atomizer of claim 1 wherein said cone further includes a plurality of spaced ribs on a lower, inner portion forming a plurality of spaced, radial grooves within which the fluid flows downward, with each of said ribs including an upper, tapered end and a lower end extending beyond the lower, peripheral edge thereof.

13. The rotary atomizer of claim 12 wherein the lower ends of said ribs form a plurality of spaced, symmetrical teeth around the periphery of said cone.

14. The rotary atomizer of claim 13 wherein each of said teeth is generally rectangular.

15. The rotary atomizer of claim 14 further comprising first flow control means positioned on an upper edge of said cone around its hub for directing the fluid downward through the apertures in said hub and upon the inner wall of said cone.

16. The rotary atomizer of claim 15 further comprising second flow control means positioned above the hub of said cone for regulating fluid flow in a uniform manner through the apertures in said hub.

17. The rotary atomizer of claim 16 wherein said rotational drive means includes a shaft and said shaft is coupled to the hub of said cone.

18. The rotary atomizer of claim 17 wherein the hub apertures are aligned with the radial grooves in the lower inner surface of said cone.

* * * * *

UNITED STATES PATENT AND TRADEMARK OFFICE

CERTIFICATE OF CORRECTION

PATENT NO. : 4,795,095

DATED : January 3, 1989

INVENTOR(S) : Ray M. Shepard

It is certified that error appears in the above—identified patent and that said Letters Patent is hereby corrected as shown below:

Column 2, line 62, delete "he" and insert -- the --.

Column 2, line 66, delete "sped" and insert -- speed --.

Column 5, line 4, delete "inverted".

Column 6, line 48, delete "inverted".

Column 7, line 54, delete "drip lets" and insert -- droplets --.

Column 8, line 42, after "claim", delete "1" and insert -- 11 --.

Signed and Sealed this

Twenty-fifth Day of April, 1989

*Attest:*

DONALD J. QUIGG

*Attesting Officer*

*Commissioner of Patents and Trademarks*